US005344711A

United States Patent [19]

Kanzaki et al.

[11] Patent Number: 5,344,711

[45] Date of Patent: Sep. 6, 1994

[54] ACRYLIC SYNTHETIC FIBER AND PROCESS FOR PREPARATION THEREOF

[75] Inventors: Hidetoshi Kanzaki; Naoki Kanamori, both of Fuji, Japan

[73] Assignee: Asahi Kasei Kogyo Kabushiki Kaisha, Osaka, Japan

[21] Appl. No.: 989,454

[22] Filed: Dec. 8, 1992

Related U.S. Application Data

[63] Continuation of Ser. No. 754,228, Aug. 28, 1991, abandoned, which is a continuation of Ser. No. 456,560, Dec. 26, 1989, abandoned.

[30] Foreign Application Priority Data

| | | | |
|---|---|---|---|
| Dec. 28, 1988 | [JP] | Japan | 63-328891 |
| Feb. 9, 1989 | [JP] | Japan | 1-28773 |
| Feb. 16, 1989 | [JP] | Japan | 1-35040 |

[51] Int. Cl.[5] ..... D02G 3/00

[52] U.S. Cl. ..... 428/398; 428/376; 428/400; 428/397; 264/41; 264/49; 264/45.8; 264/45.9

[58] Field of Search ..... 428/398, 376, 400, 397; 264/41, 49, 45.8, 45.9

[56] References Cited

U.S. PATENT DOCUMENTS

| | | | |
|---|---|---|---|
| 2,788,563 | 4/1957 | Stucklik et al. | 428/398 |
| 3,802,954 | 4/1974 | Orito et al. | 428/400 |
| 4,346,146 | 8/1982 | Kondo et al. | 428/398 |
| 4,347,203 | 8/1982 | Mimura et al. | 428/398 |
| 4,643,946 | 2/1987 | Brauer et al. | 428/400 |
| 4,663,232 | 5/1987 | Kamide et al. | 428/400 |

FOREIGN PATENT DOCUMENTS

| | | |
|---|---|---|
| 47-32122 | 11/1972 | Japan . |
| 51-149922 | 12/1976 | Japan . |
| 55-30460 | 3/1980 | Japan . |
| 57-89612 | 6/1982 | Japan . |

*Primary Examiner*—Patrick J. Ryan
*Assistant Examiner*—N. Edwards
*Attorney, Agent, or Firm*—Finnegan, Henderson, Farabow, Garrett & Dunner

[57] ABSTRACT

An acrylic synthetic fiber having in the transverse section thereof many openings having an indeterminate shape and a size of 0.1 to 1.6 μm, wherein in the interior of the fiber, each opening forms a vein-like or straw-like void extending substantially in parallel to the longitudinal axis of the fiber and having a length of at least 60 μm. This acrylic fiber is prepared by a) dissolving in a suitable solvent an acrylic polymer comprising at least 60 weight % of an acrylonitrile unit and 5 to 20 weight %, based on the weight of the acrylic polymer, of a polyalkylene glycol having a number average molecular weight of 5,000 to 50,000, b) aging the formed spinning solution for at least 4 hours, and c) extruding the spinning solution into a coagulating medium. The acrylic fiber is useful, e.g., as a frictional material comprising (a) a pulpy material made from the acrylic fiber, (b) a resin and (c) a filler.

3 Claims, 10 Drawing Sheets

ACRYLIC SYNTHETIC FIBER AND PROCESS FOR PREPARATION THEREOF

This application is a continuation of application Ser. No. 07/754,228, filed Aug. 28, 1991, now abandoned, which is a continuation of application Ser. No. 07/456,560, filed Dec. 26, 1989, now abandoned.

BACKGROUND OF THE INVENTION

1. Field of the Invention

This invention relates to an acrylic synthetic fiber, especially an acrylic synthetic fiber having vein-like or straw-like voids extending substantially in parallel to the longitudinal axis of the fiber, which can be easily split into finer fibers by an external force, and a process for the preparation of this acrylic synthetic fiber. Furthermore, the present invention relates to a pulpy acrylic synthetic fibrous article having excellent properties as the starting material for a friction material, paper or nonwoven fabric. Moreover, the present invention relates to a friction material comprising this pulpy acrylic synthetic fibrous article as a base material.

2. Description of the Related Art

Hollow acrylic fibers are known, for example, from Japanese Unexamined Patent Publication No. 51-149922 and Japanese Unexamined Patent Publication No. 57-89612. The conventional hollow acrylic fibers include a fiber having cell-like independent voids in the interior thereof and a tubular fiber having in the interior thereof a hole continuous along the fiber axis.

The hollow acrylic fiber having cell-like independent voids has only a few large voids in the transverse section thereof, as disclosed in, for example, Japanese Unexamined Patent Publication No. 51-149922.

The hollow acrylic fiber disclosed in Japanese Unexamined Patent Publication No. 57-89612 has in the transverse section thereof several of relatively large voids, as shown in the drawings of the patent publication, and this fiber cannot be easily split.

Voids in these known hollow fibers are cell-like voids or long voids extending along the longitudinal direction of the fiber, and the length of these voids is about 40 to about 50 μm at most.

The objects of forming voids in fibers in the conventional techniques are to decrease the weight, improve the heat-insulating property, impart a water-absorbing property, give a soft touch, and give a dry touch. To attain these objects, acrylic synthetic fibers having voids as disclosed in the above-mentioned patent publications provide excellent results.

Recently, the need for a fiber having a variety of greatly improved properties has increased, and attention is now focused on a fiber having characteristics such that, after a formation of a fiber structure or after a further formation of the fiber structure into a fibrous product such as a knitted or woven fabric, the fiber can be split into finer fibers by various means. Fibers having such properties are characterized in that the freedom of processability is increased, whereby the fibers can be split into finer fibers at an optional processing stage after a formation of fiber structures, and fibrous products having excellent properties not attainable from conventional fibers can be provided.

From this viewpoint, the hollow acrylic synthetic fibers disclosed in the above-mentioned patent publications have problems in that they cannot be split into finer fibers by an external force, for example, by beating and rubbing.

The main reasons why the fibers disclosed in the above-mentioned patent publications cannot be easily split into finer fibers by an external force are that (1) the proportion of voids in the transverse section of fiber is small and (2) the voids are cell-like voids and do not extend far in the longitudinal direction of the fiber.

Fibers that can be split into finer fibers by an external force are known from, for example, Japanese Unexamined Patent Publication No. 47-32122 and Japanese Unexamined Patent Publication No. 55-30460.

The fiber disclosed in Japanese Unexamined Patent Publication No. 47-32122 is a conjugate fiber in which, in the transverse section of a single filament, a water-insoluble polymer is separated into several parts by a water-soluble polyamide extending in radial directions. The fiber disclosed in Japanese Unexamined Patent Publication No. 55-30460 is a fibrilated conjugate fiber composed of a polyamide and a polymer having no affinity with the polyamide.

The costs of these fibers are inevitably high, mainly for the following reasons. Namely, since the fibers are formed by bonding at least two polymers having different characteristics, different polymers must be used, and a special spinneret must be used for the conjugation. Moreover, it is difficult to maintain a constant ratio between the two components, and when both components are made finer and bonded together, an advanced technique is necessary for adjusting the ratio between the two components.

Prior to the present invention, a fiber composed of an acrylic polymer, that can be easily split into finer fibers by an external force, was not known.

SUMMARY OF THE INVENTION

The primary object of the present invention is to provide an acrylic polymer fiber that can be easily split into fine fibers by an external force.

It was found that, if openings having an indeterminate shape are formed in the transverse section of the fiber and each opening has a vein-like or straw-like void extending substantially in parallel to the longitudinal axis of the fiber in the interior of the fiber, this fiber can be easily split into finer fibers by an external force.

More specifically, in accordance with one aspect of the present invention, there is provided an acrylic synthetic fiber having in the transverse section thereof a multiplicity of openings having an indeterminate shape and a size of 0.1 to 1.6 μm, wherein in the interior of the fiber, each opening forms a vein-like or straw-like void extending substantially in parallel to the longitudinal axis of the fiber and having a length of at least 60 μm.

In accordance with another aspect of the present invention, there is provided a process for the preparation of an acrylic synthetic fiber, which comprises a) dissolving in a suitable solvent an acrylic polymer comprising at least 60% by weight of an acrylonitrile unit and 5% to 20% by weight, based on the weight of the acrylic polymer, of a polyalkylene glycol having a number average molecular weight of 5,000 to 50,000, b) aging the formed spinning solution for at least 4 hours, and c) extruding the spinning solution into a coagulating medium through a spinneret.

DESCRIPTION OF THE PREFERRED EMBODIMENTS

The acrylic synthetic fiber of the present invention will now be described in detail.

The acrylic polymer constituting the acrylic synthetic fiber of the present invention is a homopolymer of acrylonitrile or is a copolymer comprised of at least 60% by weight (all of "%" given hereinafter are by weight unless otherwise indicated) of acrylonitrile and up to 40% of an ethylenic monomer copolymerizable with acrylonitrile, or a mixture of two or more of such polymers.

Ethylenic monomers copolymerizable with acrylonitrile are known monomers. For example, there can be mentioned acrylic acid, methacrylic acid, esters thereof (such as methyl acrylate, ethyl acrylate, methyl methacrylate and ethyl methacrylate), vinyl acetate, vinyl chloride, vinylidene chloride, acrylamide, methacrylamide, methacrylonitrile, allylsulfonic acid, methallylsulfonic acid, styrenesulfonic acid, vinylpyridine, 2-methyl-5-vinylpyridine and N,N-dimethylaminoethyl methacrylate.

As pointed out hereinbefore, the acrylic synthetic fiber of the present invention is characterized in that, in the section of the fiber cut orthogonally to the longitudinal axis of the fiber (hereinafter referred to as "the transverse section of the fiber"), many openings having an indeterminate shape are formed and each opening forms a vein-like or straw-like void extending substantially in parallel to the longitudinal axis of the fiber.

Figure 2:
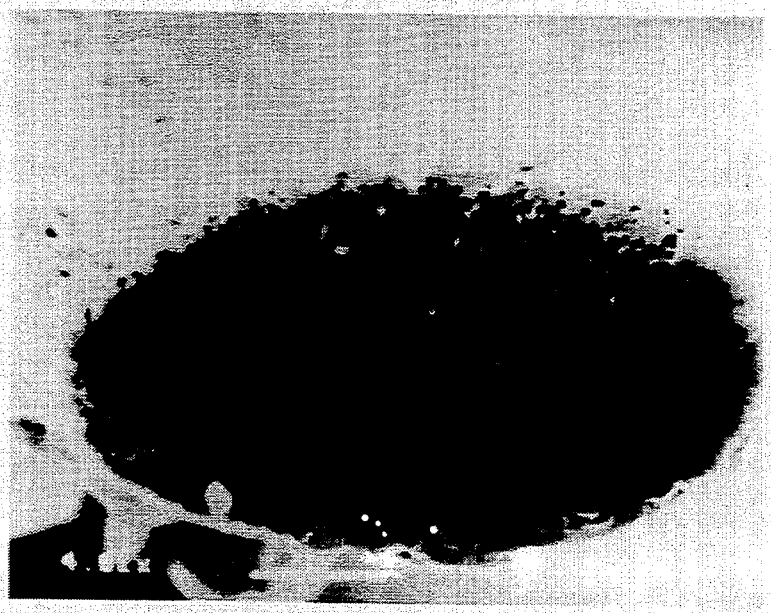
FIG. 2 is a similar photograph of the transverse section of the acrylic synthetic fiber shown in FIG. 1.

In the transverse section of the fiber of the present invention, the sectional shape of the void of each opening is indeterminate. More specifically, the sectional shapes of voids of the openings include substantially circular shapes, flat shapes, shapes of repeated bends having acute edges, shapes having a large section, shapes having a small section and the like, as shown in FIG. 2 of the accompanying drawings, and the shape and size of the voids are not constant but irregular. Since many such indeterminate voids are present, splitting can be easily performed by an external force. It is especially preferred that sectional shapes of the voids be defined by repeated bends having acute edges. If the voids have such a sectional shape, the fiber can be split more easily.

The size (diameter) of the voids is not particularly critical, so long as the requirements described hereinafter are satisfied, but to split the fiber easily and obtain fine fibers by splitting, preferably many fine voids are present. Note, even if relatively large voids are present, the intended objects can be attained if fine voids are present around these relatively large voids.

Figure 1:
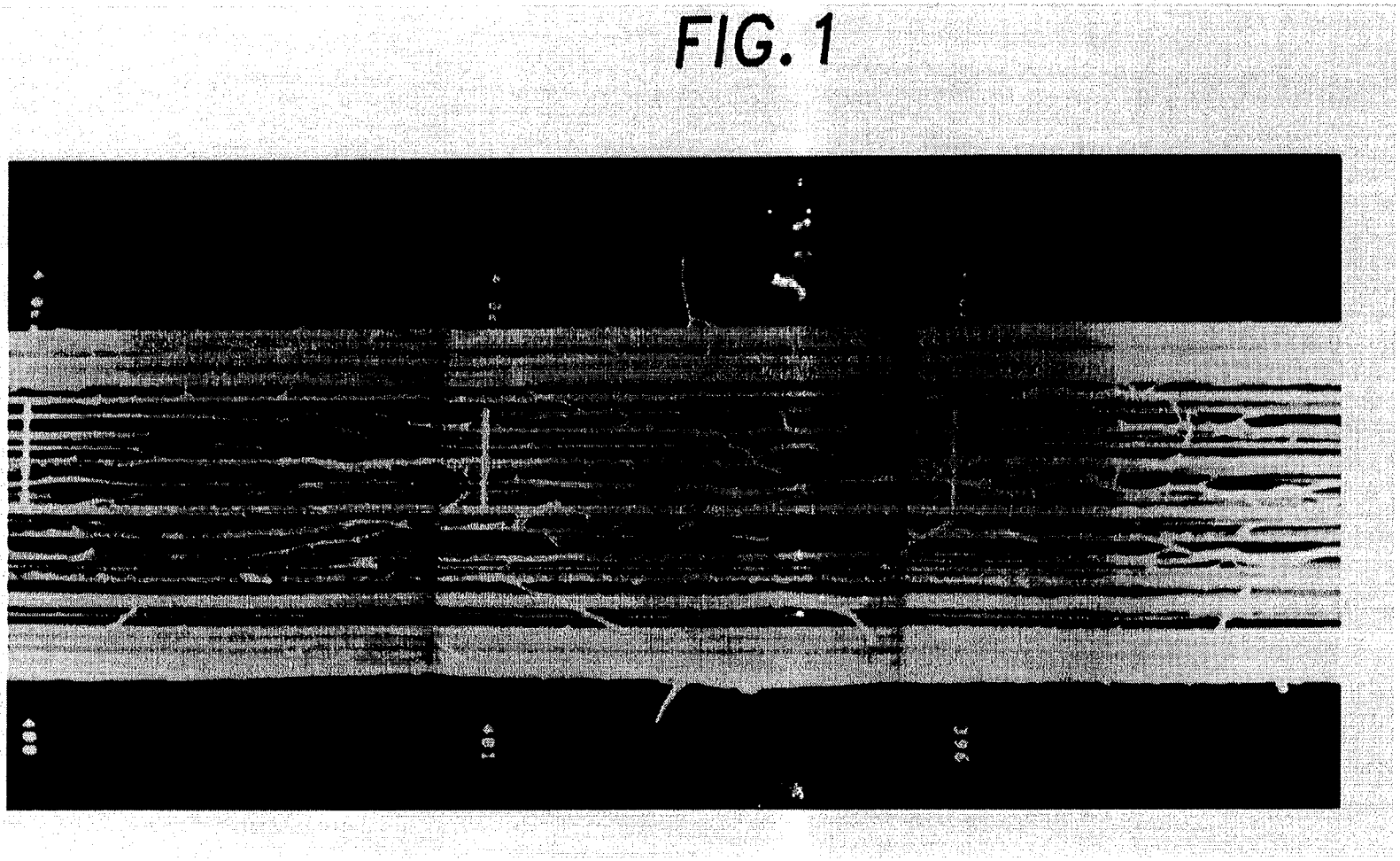
FIG. 1 is an electron microscope photograph of the longitudinal section of the acrylic synthetic fiber prepared in Example 1 according to the process of the present invention.

As shown in FIG. 1 of the accompanying drawings, each of the above-mentioned openings forms a vein-like or straw-like void extending substantially in parallel to the longitudinal axis of the fiber in the interior of the fiber.

The length of the voids along the longitudinal axis of the fiber (hereinafter referred to as "the void length") should be such that the fiber can be easily split. These slender voids are distinguishable over the conventional voids which are formed to have a relatively large and independent cell-like shape for imparting a soft touch and attaining a heat-insulating effect. In the fiber of the present invention, the void length is at least 60 μm. If the void length is smaller than 60 μm, splitting of the fiber is very difficult even if the void number is increased.

The larger the void length, the more easily split the fiber, as long as the void length is at least 60 μm. Therefore, most preferably the voids are continuous substantially along the entire length of the fiber.

In the transverse section of the fiber, voids should be present in a large number such that the fiber can be easily split, but the necessary number of voids depends on the void length and cannot be easily stipulated. If the void length is large, the fiber can be easily split even when the number of voids is relatively small, but, in general, preferably at least 100 voids are present. Where the number of voids is smaller than 100, splitting of the fiber is very difficult even if the voids are continuous voids having a length of at least 60 μm. If at least 100 voids are present in the transverse section, the more easily split the fiber, and further, the finer the split fibers.

To obtain fine split fibers, preferably the voids are uniformly dispersed in the transverse section of the fiber.

In the acrylic synthetic fiber of the present invention, the void ratio, that is, the ratio of the sectional area of the void to the total area of the transverse section of the fiber, is preferably 5 to 80%. If the void ratio is lower than 5%, the void number is small and splitting of the fiber is difficult. If the void ratio is higher than 80%, the preparation of the fiber per se is difficult.

The void ratio referred to herein is defined by the following formula:

$$\left(1 - \frac{\text{true denier}}{\text{apparent denier}}\right) \times 100\ (\%)$$

The apparent denier is calculated from the sectional area of the single fiber and the true denier is calculated by the weight method. The determination is performed with respect to 10 sample fibers of one lot, and the mean value is calculated.

The size (diameter) of the voids in the transverse section of the fiber cannot be clearly specified because the voids have an indeterminate shape, but preferably the average diameter of the circumscribed circle of the voids is at least about 0.1 $\mu$m.

As pointed out hereinbefore, the acrylic synthetic fiber of the present invention is characterized by the void length, the number of voids, and the cross-sectional shape of the voids. The fiber can be easily split by an external force due to the combination of these characteristic features, and the split fiber can be used in the form of an assembly of fine fibers or a dispersion of fine fibers.

In the present invention, the external force means the stress imposed on the fiber at the fiber-processing step, for example, by a disk refiner used in the paper-making industry or a columnar stream punching of high-pressure water adopted in the nonwoven fabric-manufacturing process.

The acrylic synthetic fiber of the present invention can be used in the fields of clothing nonwoven fabrics, paper products and the like while the foregoing characteristic properties are utilized.

The process for the preparation of the acrylic synthetic fiber of the present invention will now be described.

As pointed out hereinbefore, the acrylic polymer used in the present invention is a polymer comprising at least 60% of acrylonitrile. If the amount of acrylonitrile is smaller than 60%, the softness and wooly touch inherently possessed by the acrylic synthetic fiber are lost. The upper limit of the amount of acrylonitrile is not critical. The acrylic polymer used in the present invention can be a mixture comprising at least two kinds of acrylic polymers. In this case, the content of acrylonitrile should be at least 60% based on the total weight of the polymer mixture.

The polymer is dissolved in a known solvent for acrylic polymers, for example, an organic solvent such as dimethylformamide, dimethylacetamide or dimethylsulfoxide, a concentrated aqueous solution of an inorganic salt such as a rhodanate, zinc chloride, or a concentrated aqueous solution of an inorganic acid such as nitric acid, whereby a spinning solution is prepared. An optimum concentration of the polymer in the spinning solution depends on the kind of the solvent, but in general, preferably the polymer concentration is 10 to 30%.

A polyalkylene glycol is added to this spinning solution. The addition of the polyalkylene glycol is one of important requirements for the preparation of the acrylic synthetic fiber of the present invention. Especially, the molecular weight and amount of the polyalkylene glycol added make great contributions to formation of voids.

The polyalkylene glycol is preferably a random or block copolymer comprising ethylene oxide and propylene oxide at a weight ratio of from 80/20 to 20/80. The number average molecular weight of the polyalkylene glycol is 5,000 to 50,000, preferably 10,000 to 20,000. If the number average molecular weight of the polyalkylene glycol is lower than 5,000, voids continuously extending in the longitudinal direction of the fiber cannot be formed, and a microporous fiber having very fine, substantially spherical voids is formed. If the number average molecular weight of the polyalkylene glycol is higher than 50,000, a fiber having large vein-like voids is obtained, and in the transverse section of the obtained fiber, only a few of the needed of voids are present. This fiber cannot be split into fine fibers by an external force such as a columnar stream of a liquid. Especially, if the number average molecular weight of the polyalkylene glycol is 10,000 to 20,000, a fiber having fine and slender voids which are continuous along the longitudinal direction of the fiber and having an indeterminate cross-sectional shape in the transverse section of the fiber can be obtained.

To prepare the acrylic synthetic fiber of the present invention, the spinning solution formed by dissolving the polyalkylene glycol must be aged for at least 4 hours.

By the term "aging" as used herein is meant that the spinning solution formed by dissolving the acrylic polymer and polyalkylene glycol is not violently stirred or shaken but, for example, the spinning solution is allowed to stand or is gently moved, for example, gently delivered through a pipe.

The reason why an acrylic synthetic fiber having the above-mentioned voids can be obtained by thus aging the spinning solution in the present invention has not been elucidated, but it is considered that the reason is probably as follows. Namely, if the spinning solution is aged for at least 4 hours, cohesion of the polyalkylene glycol occurs, and when the spinning solution passes through a pipe and is spun into a coagulating medium from a spinneret, the shearing force acts on the spinning solution and fine streaks of the polyalkylene glycol are formed. Then, a phase separation occurs between the two polymers, because of a difference of coagulating characteristics, that is, coagulation of the acrylic polymer and non-coagulation of the polyalkylene glycol, whereby voids having a complicated shape as mentioned above are formed.

Thus, the spinning solution must be aged for at least 4 hours before the spinning.

In the foregoing points, the process and fiber of the present invention are essentially distinguishable over the process and fiber disclosed in Japanese Unexamined Patent Publication No. 57-89612. More specifically, in the process disclosed in Japanese Unexamined Patent Publication No. 57-89612, a polyalkylene oxide having a number average molecular higher than 100,000 is used. If a polyalkylene oxide having such a high molecular weight is used, the polyalkylene oxide is dispersed in the form of spheres in the spinning solution, as taught in the above-mentioned patent publication. Accordingly, when this spinning solution is spun in a coagulating bath, spheres of the polyalkylene oxide are present in the fiber, and the polyalkylene oxide is eluted in the coagulating bath, water-washing bath or drawing bath and there remain spherical voids or voids elongated in the longitudinal direction of the fiber according to the degree of drawing.

In contrast, in the present invention, since the polyalkylene glycol used has a low molecular weight such as a number average molecular weight of 5,000 to 50,000, the polyalkylene glycol is dissolved in the spinning solution to form a homogeneous solution, and if this solution is aged, cohesion of the polyalkylene glycol occurs in the spinning solution. By aging the spinning solution for at least 4 hours, fine streaks are formed by the cohesion of the polyalkylene glycol. When this spinning solution is extruded into the coagulating bath, in the coagulated fiber, a phase separation into the acrylic polymer and the streak-like polyalkylene glycol occurs, and simultaneously, by elution of the polyalkylene glycol, fine voids are formed in the coagulated fiber.

The aging time is at least 4 hours and the upper limit of the aging time is not critical, but preferably 6 to 10 hours.

In the present invention, the amount of the polyalkylene glycol added is 5 to 20%, preferably 10 to 15%, based on the acrylic polymer. If the amount of the polyalkylene glycol added is smaller than 5%, the number of voids present in the transverse section of the fiber is small, and a fiber having many voids, for example, at least 100 voids, cannot be obtained. If the amount of the polyalkylene glycol added is larger than 20%, the number of openings increases but the number of openings is too large and the fiber is split during the preparation or the spinning cannot be carried out stably. If the amount of the polyalkylene glycol added is 10 to 15%, the best balance between the number of openings and the spinning stability is maintained.

In the foregoing description, the polyalkylene glycol is added after the preparation of the spinning solution but the mixing method is not limited to this method, and the spinning solution can be prepared according to a method in which the polyalkylene glycol is mixed with the acrylic polymer and the mixture is dissolved in a solvent for the polymer, or a method in which the polyalkylene glycol is dissolved in advance in a solvent for the acrylic polymer and the acrylic polymer is then dissolved in the solution.

The spinning solution is extruded into a coagulating medium for the spinning solution through a spinneret, and the extrudate is passed through water-washing, drawing and drying steps and is heat-set according to need.

In this preparation process, the polyalkylene glycol is eluted from the coagulated fiber during the coagulating, water-washing and drawing steps. Steps subsequent to the spinning step, as adopted in the conventional process for the preparation of acrylic synthetic fibers, can be directly adopted in the present invention.

Namely, in the present invention, as the means for spinning the spinning solution, there can be adopted the wet spinning method comprising extruding the spinning solution into a dilute aqueous solution of a solvent, the dry spinning method comprising extruding the spinning solution into an inert gas such as air or nitrogen gas, and the dry-wet spinning method comprising extruding the spinning solution into the above-mentioned inert gas and then introducing the extrudate into a dilute aqueous solution of a solvent. The coagulated fiber obtained by the spinning is washed with water and then drawn, water-washed and simultaneously drawn, or drawn and then water-washed, whereby the solvent is removed.

The drawing is carried out in water, a solvent-containing aqueous solution or steam at 50° to 150° C. at a draw ratio of several to ten-odd times. The drawing can be performed in a single stage or a plurality of stages. Moreover, several drawing media can be used in combination. The drawn fiber is dried, and if desired, the dried fiber is subjected to the secondary drawing or to the heat treatment, whereby the acrylic synthetic fiber of the present invention can be obtained.

The acrylic synthetic fibrous article of the present invention will now be described.

By the term "acrylic fibrous article" used herein is meant a pulpy fibrous article prepared from the above-mentioned acrylic synthetic fiber. More specifically, the acrylic fibrous article of the present invention is characterized as having as a trunk an acrylic synthetic fiber having in the transverse section thereof a multiplicity of openings having an indeterminate shape and a size of 0.1 to 1.6 μm, wherein in the interior of the fiber, each opening forms a vein-like or straw-like void extending substantially in parallel to the longitudinal axis of the fiber and having a length at least 60 μm, and the surface of the trunk has a multiplicity of fine fibrils branched from the trunk and the trunk is partially split in the longitudinal direction of the trunk and separated into a plurality of fibers.

The acrylic synthetic fibrous article of the present invention can be easily prepared by applying an external force to the above-mentioned acrylic synthetic fiber, for example, by beating the acrylic synthetic fiber by a disk refiner customarily adopted in the paper-making industry or by punching the acrylic synthetic fiber by a high-pressure water columnar stream adopted in the nonwoven fabric-preparing process. At this step, the amount of generated fibrils, the fineness of the fibrils and the frequency of splitting of the trunk can be adjusted by appropriately selecting the conditions of the external force applied to the fiber.

Figure 14:
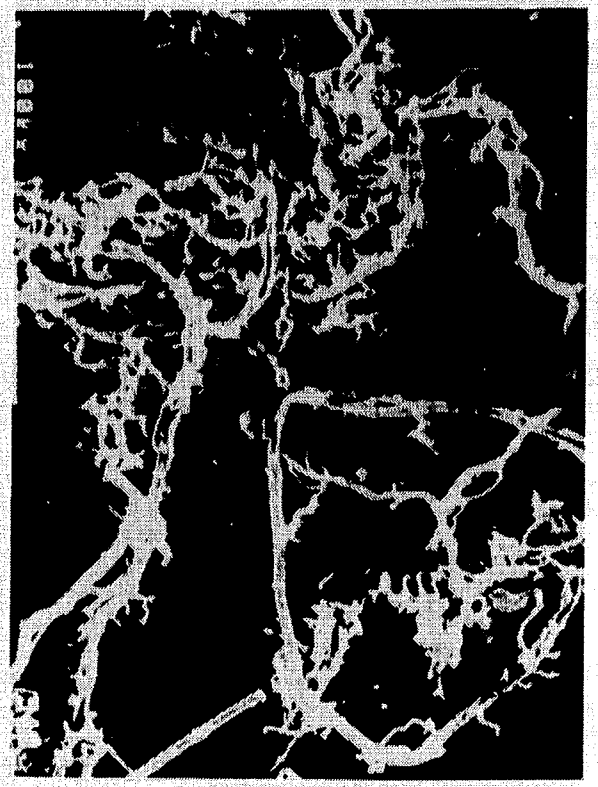
FIG. 14 is an electron microscope photograph (100 magnifications) of the shape and construction of the acrylic synthetic fibrous article prepared in Example 6.

FIG. 14 is an electron microscope photograph (100 magnifications) of the fibrous article obtained by beating the fiber shown in FIG. 2. As is seen from FIG. 14, a multiplicity of fine fibrils branched from the fiber are formed on the surface of the fiber, and it is seen that the acrylic synthetic fiber constituting the trunk is partially split into a plurality of finer fibers.

The fine fibrils branched from the acrylic synthetic fiber or trunk may have many voids extending along the longitudinal axis of the fiber, as well as the acrylic synthetic fiber or trunk, or the fine fibrils may not have such voids.

The acrylic synthetic fiber is split in a plurality of finer fibers at an optional position in the longitudinal direction of the fiber, but this splitting position is not critical.

The fact that the trunk fiber is split in a plurality of fine fibers at an optional position means that the fiber has an improved softness and pliability, and a paper or sheet product or nonwoven fabric having high elasticity and bulkiness can be obtained from this fiber.

The friction material of the present invention will now be described.

This frictional material is prepared from the above-mentioned acrylic synthetic fiber.

More specifically, the frictional material of the present invention is characterized as comprising an acrylic synthetic fibrous article, a resin and a filler, said acrylic synthetic fibrous article having as a trunk an acrylic fiber having in the transverse section thereof a multiplicity of openings having an indeterminate shape and a size of 0.1 to 1.6 μm, wherein in the interior of the fiber, each opening forms a vein-like or straw-like void extending substantially in parallel to the longitudinal axis of the fiber and having a length of at least 60 μm, and the surface of the trunk has a multiplicity of fine fibrils branched from the trunk and the trunk is partially split in the longitudinal direction of the trunk and separated into a plurality of fibers.

By using the fiber having the above-mentioned specific shape as the substrate of the friction material, the friction coefficient and abrasion resistance are highly improved in the obtained friction material.

The reason for this improvement has not been elucidated, but it is considered that the reason is probably as follows. Namely, since the acrylic synthetic fiber of the present invention has many vein-like voids in the trunk, the resin and filler are allowed to intrude into these voids, and since many fine fibrils are present on the surface of the trunk, the resin and filler intrude into spaces defined by the trunk and fibrils. Accordingly, the fibrous article, resin and filler are very closely integrated as a whole.

The transverse section and longitudinal section of each of the fine fibers formed at the split portion of the acrylic fiber or trunk depend on the splitting degree, but if the splitting degree is low, for example, if the trunk fiber is split into 2 to 10 fine fibers, these sections are substantially the same as those of the original fiber (trunk) except that the number of openings in the transverse section should naturally be smaller than the number of openings in the transverse section of the original fiber (trunk). If the splitting degree is very high, openings are not found in transverse sections of some of fine fibers formed by splitting.

In the transverse sections of fine fibrils branched from the trunk, openings are found or not found, and the presence or absence of openings depends on the branching degree. Namely, where the fibrils are relatively thick, openings are found, and where the fibrils are very fine, openings are not found. Generally, these fine and thick fibrils are mingled.

The acrylic synthetic fibrous article of the present invention is contained preferably in an amount of 10 to 70%, more preferably 20 to 60%, in the friction material. If the content of the fiber is lower than 10%, no substantial improvement of the friction coefficient or abrasion resistance is obtained even by using the fiber as base material. If the fiber content exceeds 70%, the resulting product is not suitable as the friction material because the amount of the fiber is too large. Preferably, the content of the resin is 20 to 70%, and the content of the filler is 10 to 50%.

A resin customarily used for friction materials can be used in the present invention. For example, phenolic resins, epoxy resins, polyimide resins, melamine resins, natural rubbers and synthetic rubbers can be used.

In the present invention, the filler is used for improving the characteristics of the friction material. In general, at least one member selected from the group consisting of metal powders, silica, clay, wollastonite, mica, talc, diatomaceous earth, calcium carbonate, cashew dust and graphite can be used as the filler.

For improving the characteristics of the friction material, other fibrous material such as a glass fiber, a metal fiber, a carbon fiber, a flame-retardant fiber, a polyvinyl alcohol fiber, a polyamide fiber, a polyester fiber, an acrylic fiber or cotton can be incorporated.

In the acrylic synthetic fibrous article of the present invention, the acrylic fiber as the trunk has many vein-like or straw-like voids. Accordingly, the resin and filler are allowed to intrude easily into these voids. Moreover, the resin and filler intrude into spaces formed by partial splitting of the trunk and the fine fibrils branched from the trunk. Accordingly, the fibrous article, resin and filler are very closely and intimately mingled and integrated with one another. Therefore, the friction material has a high friction coefficient and an excellent abrasion resistance.

The acrylic synthetic fibrous article used for the friction material of the present invention can be prepared by beating the above-mentioned acrylic synthetic fiber by a disk refiner customarily used in the paper-making industry. At this step, the degree of formation of fine fibrils and the degree of splitting of the trunk are changed according to the properties required for the friction material. In general, these degrees are preferably such that the freeness, used for indicating the beating degree of pulp in the paper-making industry, is about 600 to about 200 cc, but the freeness is not limited to within this range, and may be larger than 600 cc or smaller than 200 cc. Namely, the freeness can be appropriately set according to the properties required for the friction material. Note, the freeness referred to herein is the value determined according to the method of JIS P8121-1976.

The acrylic synthetic fibrous article is mixed with the resin and filler and molded into a friction material.

The friction material can be prepared according to a process in which a substrate comprising the acrylic synthetic fibrous article and filler, for example, a paper-like sheet or a nonwoven fabric, is prepared and the substrate is impregnated with the resin, molded and then cured, a method in which the acrylic synthetic fibrous article is mixed with the resin and filler, and the mixture is molded and then curing, and other known methods.

The present invention will now be described in detail with reference to the following examples that by no means limit the scope of the invention.

ACRYLIC SYNTHETIC FIBER AND PROCESS FOR PREPARATION THEREOF

EXAMPLE 1

A polymer comprising 95.0% of acrylonitrile, 4.5% of methyl acrylate and 0.5% of sodium methallylsulfonate and a polyethylene oxide/polypropylene oxide/polyethylene oxide block polyether (number average molecular weight=10,000, polyethylene oxide/polypropylene oxide ratio=70/30) were dissolved in dimethylformamide to form a spinning solution containing 23% of the acrylic polymer and 2.3% of the block polyether. The spinning solution was allowed to stand for 6 hours and then was extruded into a coagulating bath maintained at 35° C. and having a dimethylformamide concentration of 75% through a spinneret. The extrudate was washed with water, drawn at a draw ratio of 12 in boiling water and dried in hot air at 80° C. to obtain a fiber having a fineness of 1.5 d.

An electron microscope photograph (4,000 magnifications) of the longitudinal section of the fiber cut in the longitudinal direction (hereinafter referred to as "longitudinal section" ) is shown in FIG. 1, and a similar photograph of the transverse section of the fiber is shown in FIG. 2.

In FIG. 1, black portions are spaces, and it is seen that these spaces are continuous streak-like spaces extending substantially in parallel to one another along the longitudinal axis of the fiber. When the longitudinal section of the fiber was observed, these spaces were found to have a length of at least 60 μm.

In FIG. 2, black portions are openings, and it is seen that these openings include substantially circular openings, flat openings, openings having a shape of repeated bends having acute edges, openings having a large section, openings having a small section, and various openings having an indeterminate shape, are irregularly mingled with one another.

The void ratio of the obtained fiber was 35%.

The fiber was treated with a high-pressure water stream jetted under a pressure of 50 kg/cm$^2$ from a nozzle having an orifice diameter of 0.15 mm 10 times, whereby the fiber was split into fine fibers to form an assembly of fine-denier fibers.

Figure 3:
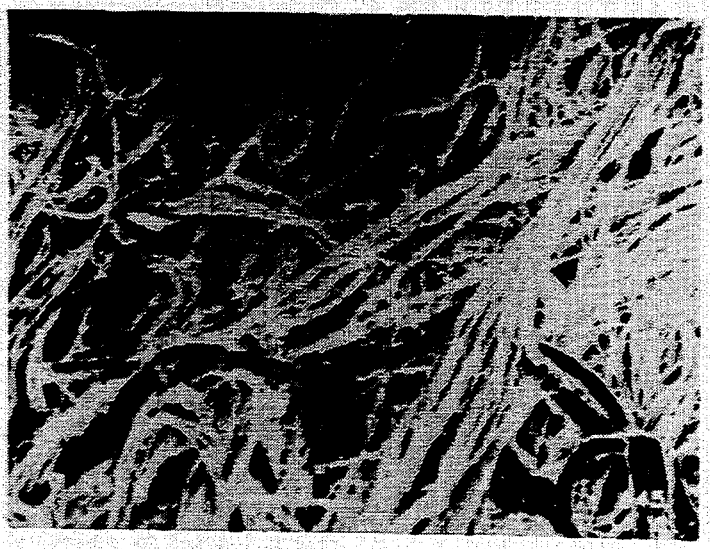
FIG. 3 is a similar photograph of the fiber obtained by splitting the acrylic synthetic fiber shown in FIG. 1.

FIG. 3 is an electron microscope photograph (200 magnifications) of the obtained assembly. As is seen FIG. 3, the fiber of the present invention can be easily split by an external force to form an assembly of finer continuous fibers.

EXAMPLE 2

The same acrylic polymer as used in Example 1 and an ethylene oxide/propylene oxide random copolymer polyether (number average molecular weight=10,000, ethylene oxide/propylene oxide ratio=75/25) were dissolved in a 67% aqueous solution of nitric acid to form a spinning solution having an acrylic polymer concentration of 16% and a random copolymer polyether concentration of 2.4%. The spinning solution was allowed to stand for 4 hours and then was extruded into a 37% aqueous solution of nitric acid maintained at 0° C. through a spinneret. The extrudate was washed with water, drawn at a draw ratio of 10 and dried by hot air at 70° C. to obtain a fiber having a fineness of 3.5 d. The void ratio of the fiber was 40%.

Figure 4:
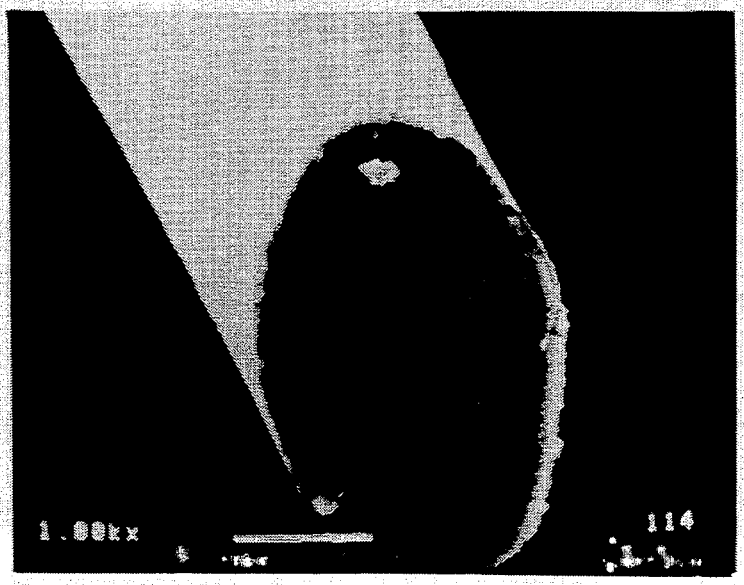
FIG. 4 is an electron microscope photograph of the transverse section of the acrylic synthetic fiber prepared in Example 2 according to the present invention.

An electron microscope photograph (1,000 magnifications of the transverse section of the obtained fiber is shown in FIG. 4. When the longitudinal section of the fiber was observed, continuous streak-like spaces having a length of at least 60 μm were found.

Figure 5:
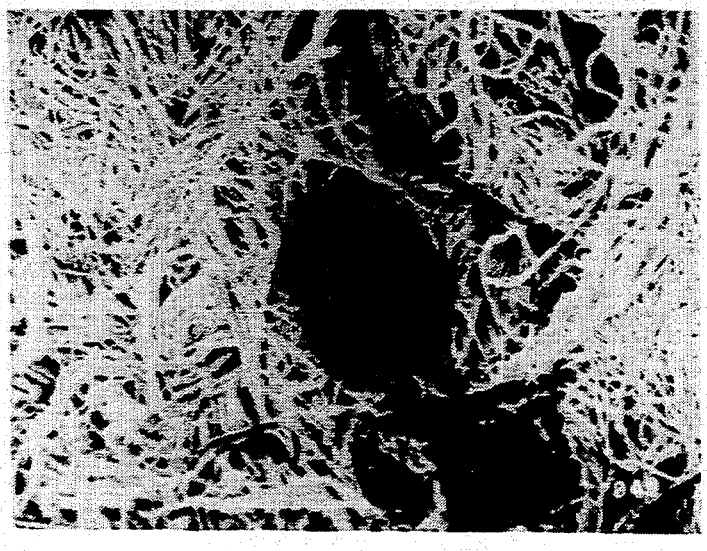
FIG. 5 is a similar photograph of the fiber obtained by splitting the acrylic synthetic fiber shown in FIG. 4.
Figure 6:
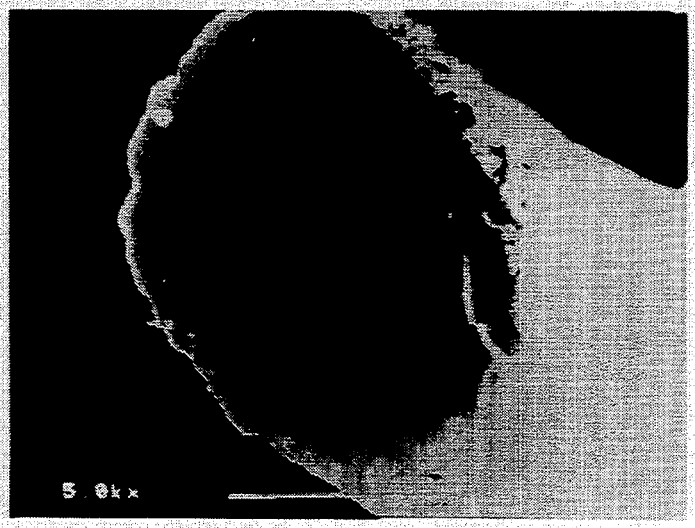
FIGS. 6 and 10 are similar photographs of the transverse sections of the comparative acrylic synthetic fibers obtained in Example 3.
Figure 7:
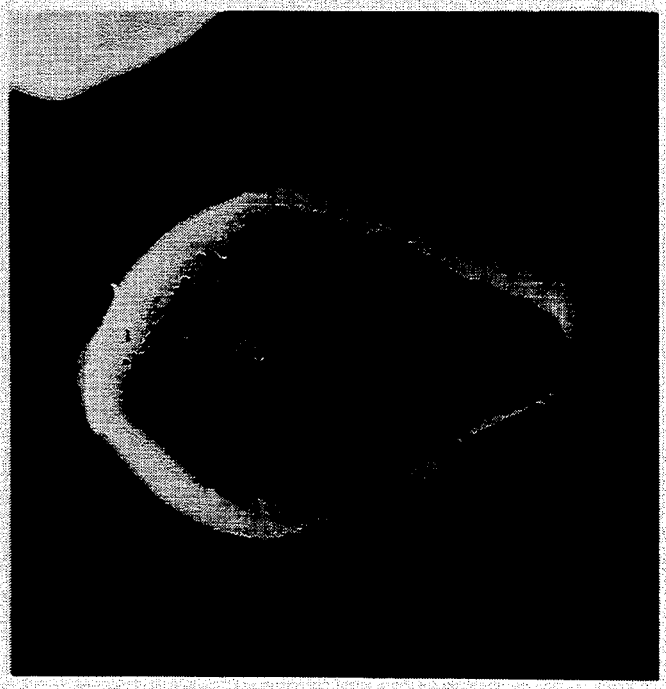
FIGS. 7 through 9 are electron microscope photographs of the transverse sections of the acrylic synthetic fibers prepared in Example 3 according to the process of the present invention.
Figure 8:
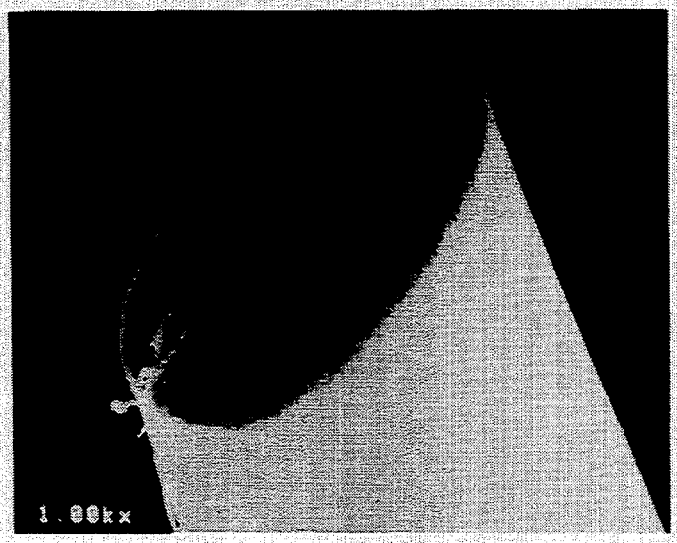
Figure 9:
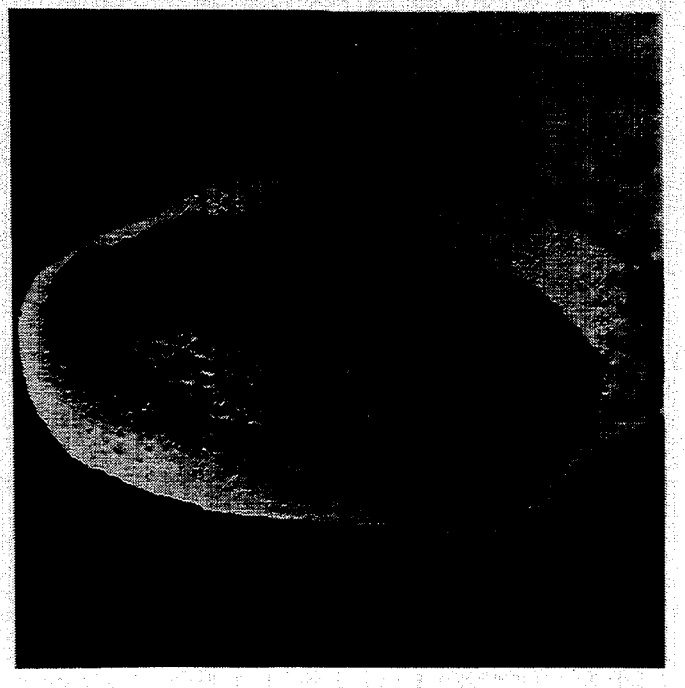
Figure 10:
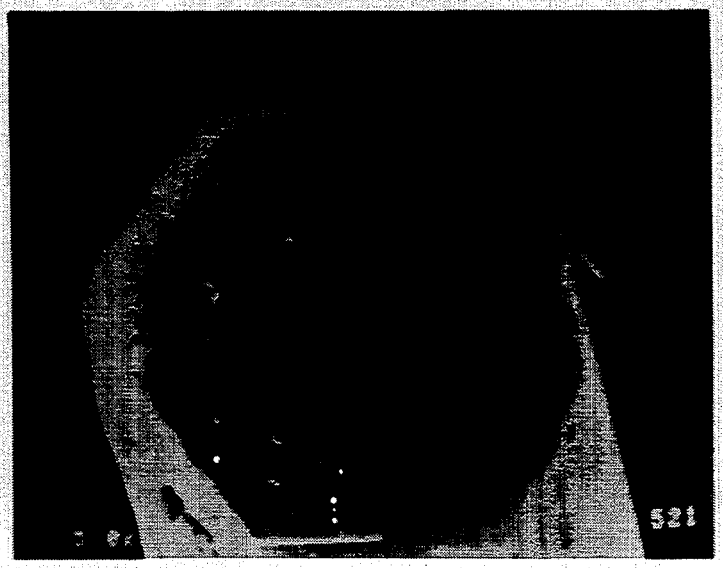

The obtained fiber was treated with a high-pressure water stream 5 times in the same manner as described in Example 1 to obtain an assembly of finely split fibers. An electron microscope photograph (200 magnifications) of the obtained assembly is shown in FIG. 5.

For comparison, the above procedures were repeated in the same manner except that the aging time of the spinning solution was changed to 3 hours. The transverse section of the obtained fiber and several large and long voids. This fiber could not be split by a high pressure water stream.

EXAMPLE 3

An acrylic polymer comprising 97% of acrylonitrile, 2.5% of methyl acrylate and 0.5% of sodium allylsulfonate and an ethylene oxide/propylene oxide random copolymer polyether having an ethylene oxide/propylene oxide copolymerization ratio of 75/25 and a number average molecular weight of 3,000, 5,000, 30,000, 50,000 or 60,000 were dissolved in a 67% aqueous solution of nitric acid at 0° C. to form a spinning solution. In the spinning solution, the acrylic polymer concentration was 18% and the polyalkylene glycol concentration was 1.8%.

The spinning solution was slowly delivered in a pipe over a period of 5 hours and then was extruded into a 38% aqueous solution of nitric acid at 0° C. through a spinneret. The extrudate was washed with water, drawn at a draw ratio of 8 in boiling water and dried in hot air at 70° C. to obtain a fiber.

Electron microscope photographs of the transverse sections of the obtained fibers are shown in FIGS. 6 through 10, and the obtained fibers are summarized in Table 1. In Table 1, the amount of the polyalkylene glycol added is expressed in terms of % based on the acrylic polymer. When the longitudinal sections of the fibers shown in FIGS. 7, 8 and 9 were observed, continuous streak-like spaces having a length of at least 60 μm were found.

These fibers were treated with a high-pressure water stream in the same manner as described in Example 1. The fibers of the present invention were split into finer fibers, but little splitting of the comparative fibers occurred.

TABLE 1

| Run No. | Molecular weight | Polyalkylene glycol Amount added **(%) | Fineness (denier) | Electron microscope photograph Magnifications | FIG. No. | Void ratio (%) |
|---|---|---|---|---|---|---|
| 1* | 3,000 | 10 | 1 | 5000 | 6 | 2.4 |
| 2 | 5,000 | 10 | 1 | 5000 | 7 | 15 |
| 3 | 30,000 | 10 | 3.5 | 1000 | 8 | 38 |
| 4 | 50,000 | 10 | 1 | 5000 | 9 | 20 |
| 5* | 60,000 | 10 | 1 | 5000 | 10 | 3.8 |

*comparative example
**based on the weight of the polymer

EXAMPLE 4

An acrylic polymer comprising 96% of acrylonitrile, 3.5% of vinyl acetate and 0.5% of sodium styrene-sulfonate and an ethylene oxide/propylene oxide random copolymer polyalkylene glycol (ethylene oxide/propylene oxide ratio=75/25, number average molecular weight=20,000) were dissolved in a 67% aqueous solution of nitric acid at 0° C to form a spinning solution. In the spinning solution, the concentration of the acrylic polymer was 16% and the concentration of the polyalkylene glycol was 3, 5, 20 or 24%. The obtained spinning solution was allowed to stand for 5 hours and extruded into a 38% aqueous solution of nitric acid at 0° C. through a spinneret. The extrudate was washed with water, drawn at a draw ratio of 10 in boiling water, and dried in hot air at 70° C. to form a fiber.

When the polyalkylene glycol concentration was 24%, yarn breakage occurred during the spinning operation and it was difficult to carry out a stable spinning operation.

Figure 11:
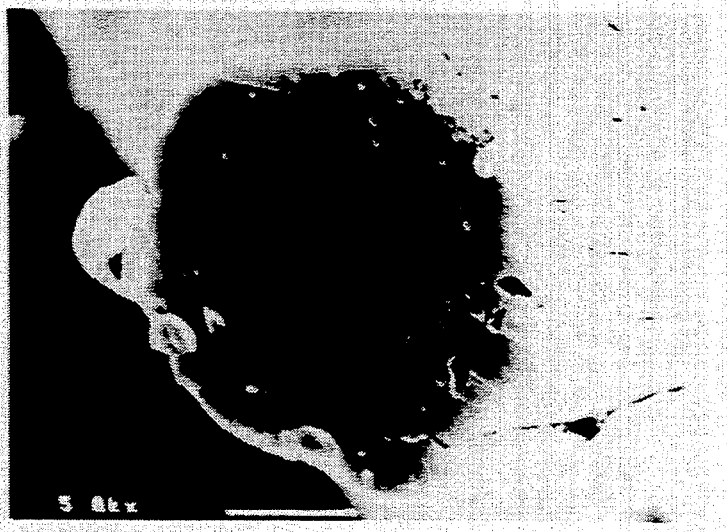
FIG. 11 is similar photograph of the transverse section of the comparative acrylic synthetic fiber obtained in Example 4.
Figure 12:
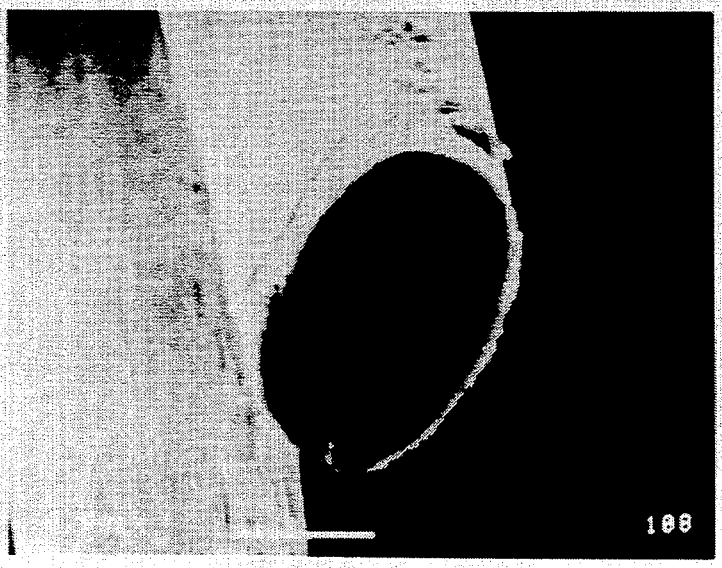
FIGS. 12 and 13 are electron microscope photographs of the transverse sections of the acrylic synthetic fibers prepared in Example 4 according to the process of the present invention.
Figure 13:
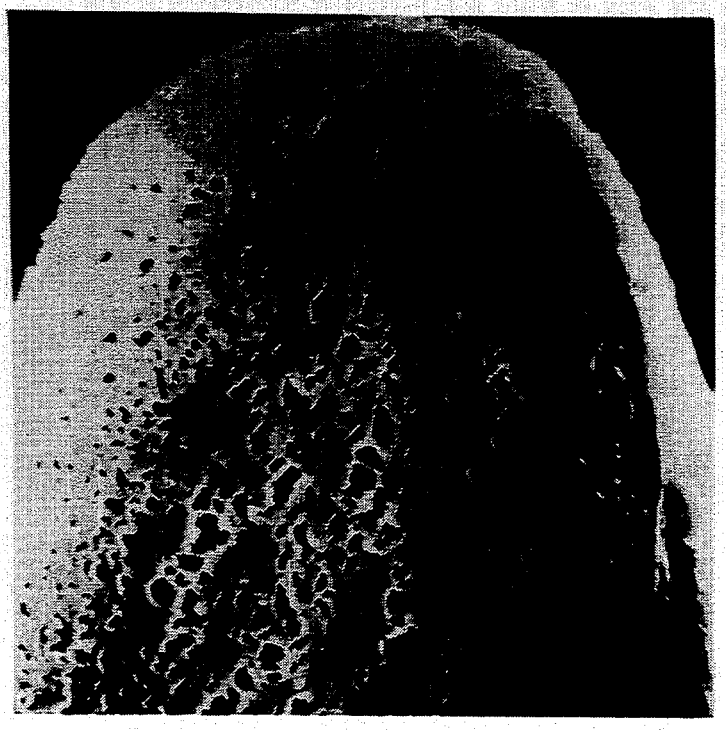

Electron microscope photographs of the transverse sections of the obtained fibers are shown in FIGS. 11 through 13. The obtained fibers are summarized in Table 2. When the longitudinal sections of the fibers shown in FIGS. 12 and 13 were observed, continuous streak-like spaces having a length of at least 60 μm were found.

Then the fibers were treated with a high-pressure water stream in the same manner as described in Example 1. The fibers of the present invention were split into finer fibers, but when the polyalkylene glycol concentration was 3%, the number of voids was small and the fiber could not be split into finer fibers.

TABLE 1

| Run No. | Molecular weight | Polyalkylene glycol Amount added **(%) | Fineness (denier) | Electron microscope photograph Magnifications | FIG. No. | Void ratio (%) |
|---|---|---|---|---|---|---|
| 1* | 20,000 | 3 | 1.5 | 5000 | 11 | 2.4 |
| 2 | 20,000 | 5 | 3 | 1000 | 12 | 8 |
| 3 | 20,000 | 20 | 7 | 5000 | 13 | 60 |
| 4* | 20,000 | 24 | — | — | — | |

*comparative example
**based on the weight of the polymer

EXAMPLE 5

A polymer comprising 95.0% of acrylonitrile, 4.5% of methyl acrylate and 0.5% of sodium methallylsulfonate and a polyethylene oxide/polypropylene oxide/polyethylene oxide block copolymer polyether (number average molecular weight=10,000, polyethylene oxide/polypropylene oxide ratio=70/30) were dissolved in dimethylformamide to form a spinning solution having an acrylic polymer concentration of 23% and a block copolymer polyether concentration of 2.3%.

The spinning solution was allowed to stand for 4 hours and then was extruded into a coagulating bath maintained at 24° C. and having a dimethylformamide concentration of 76% through a spinneret. The coagulated fiber was washed with water, drawn at a draw ratio of 9 in boiling water and dried in hot air at 80° C. to obtain a fiber having a fineness of 1.5 denier.

Figure 15:
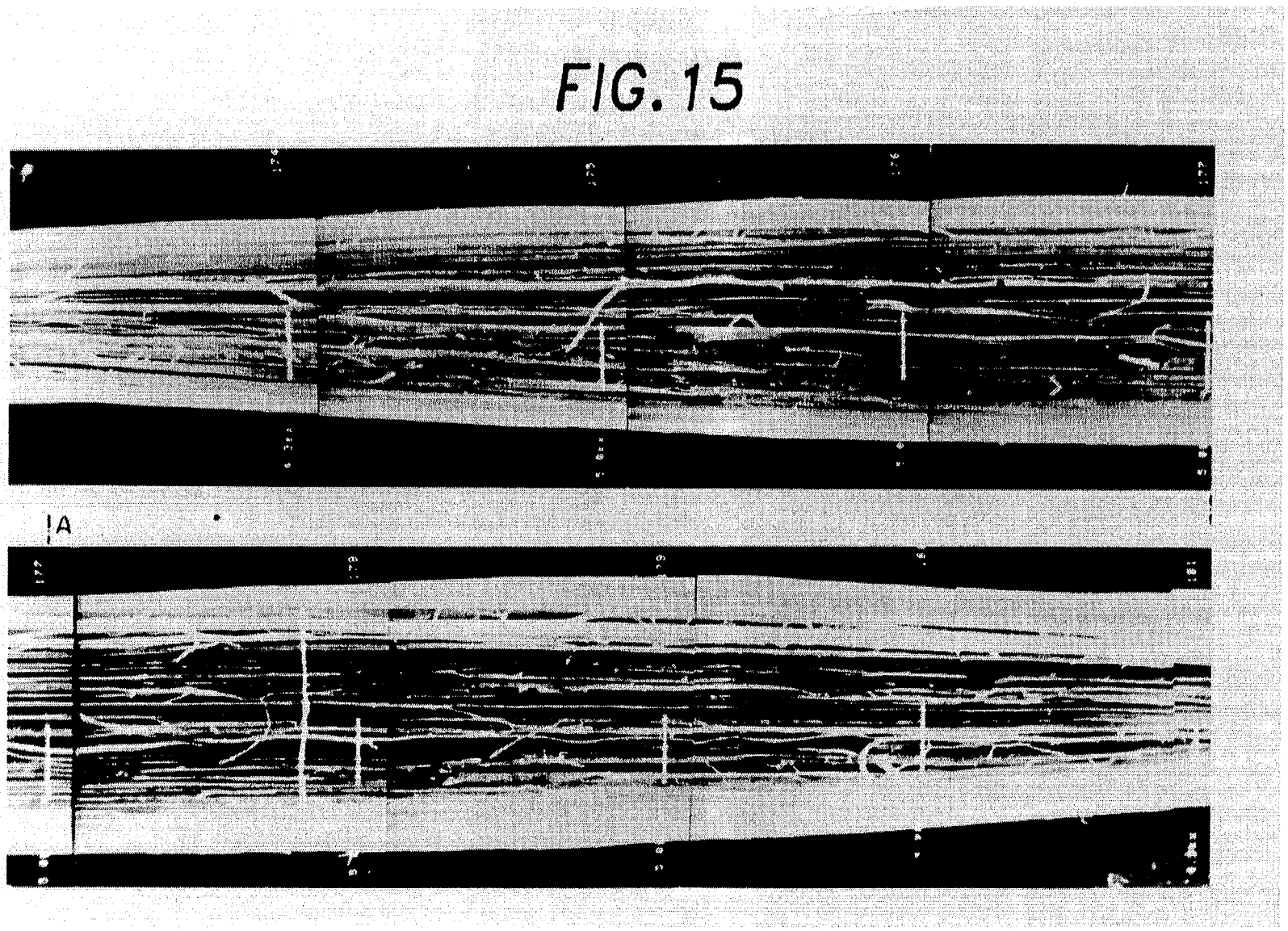
FIG. 15 is an electron microscope photograph (5,000 magnifications) of the longitudinal section of the acrylic synthetic fiber prepared in Example 5.
Figure 16:
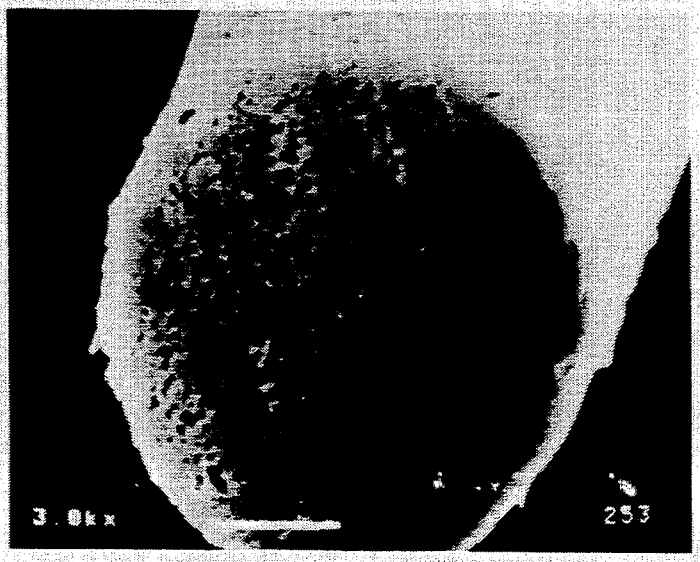
FIG. 16 is a similar photograph (3,000 magnifications) of the transverse section of the acrylic synthetic fiber shown in FIG. 15.

FIG. 15 shows an electron microscope photograph (5,000 magnifications) of the longitudinal section of the fiber cut along the longitudinal axis of the fiber, and FIG. 16 shows a similar photograph (3,000 magnifications) of the transverse section of the fiber.

In FIG. 15, the two photographs are linked together at the respective alternate long and short dash lines (a—a). In FIG. 15, the black portions are spaces, and it is seen that these spaces are continuous streak-like spaces extending substantially in parallel to one another along the longitudinal axis of the fiber. These spaces had a length of at least 60 μm.

In FIG. 16, black portions are openings, and it is seen that these openings include substantially circular openings, flat openings, openings having a shape of repeated bends having acute edges, openings having a large section, openings having a small section, and various openings having an indeteminate shape are irregularly mingled with one another.

The void ratio of the obtained fiber was 37%.

Then the fiber was treated with a high-pressure water stream jetted under a pressure of 50 kg/cm$^2$ from a nozzle having an orifice diameter of 0.15 mm 10 times, whereby the fiber was split into finer fibers to form an assembly of fine-denier fibers.

Figure 17:
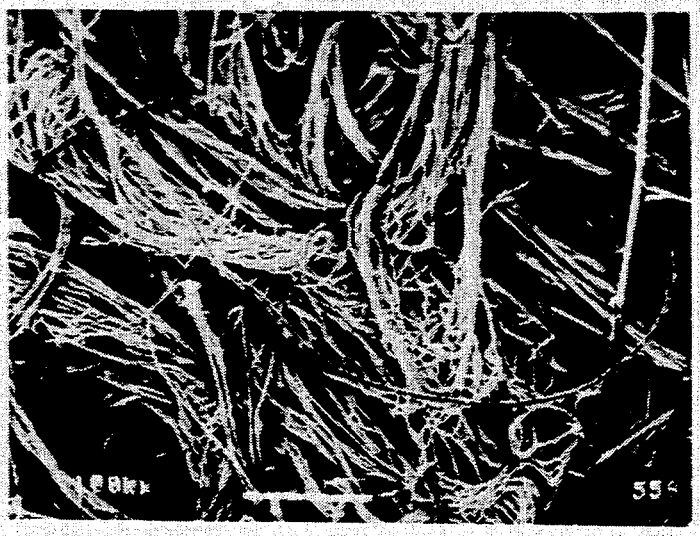
FIG. 17 is an electron microscope photograph (200 magnifications) of the fiber obtained by splitting the acrylic synthetic fiber shown in FIGS. 15 and 16.

FIG. 17 is an electron microscope photograph (100 magnifications) of the obtained assembly of fine-denier fibers.

ACRYLIC SYNTHETIC FIBROUS ARTICLE

EXAMPLE 6

The acrylic synthetic fiber prepared in Example 1 was cut to 15 mm, and 10 parts of the cut fiber was dispersed in 90 parts of water, and the fiber dispersion was treated by a paper-making disk refiner having a disk clearance adjusted to 0.1 mm and beaten so that the freeness was 450 cc.

Since the fiber of the present invention had voids, the fiber was easily split at the beating step and fibrils were formed very easily.

FIG. 14 shows an electron microscope photograph (100 magnifications) of the fibrous article formed by the beating. From this photograph, it is seen that many fine fibrils branched from the thick fiber (the original acrylic synthetic fiber as the trunk) were formed on the surface of the trunk, and that the trunk fiber was partially split in the longitudinal direction and separated into the fibers.

The aqueous dispersion containing the beaten fiber was passed through an ordinary paper-making machine and then dried by hot air at 85° C. to obtain a sheet-like product having a basis weight of 45 g/m$^2$. The obtained sheet-like product was a pliable and elastic paper-like nonwoven fabric having a soft touch.

When the sheet-like product was dried after the paper-making operation, no substantial shrinkage was observed in the longitudinal or transverse direction of the sheet-like product, and the paper-like sheet product had a very uniform plane.

FRICTION MATERIAL

EXAMPLE 7

In a Henschel mixer, 50% of the acrylic synthetic fibrous article prepared in Example 6, 25% of a phenolic resin and 25% of calcium carbonate as the filler were sufficiently mixed, and the mixture was compression-molded in a mold at 150° C. under 5 kg/cm$^2$ for 10 minutes to form a pad of a disk brake for an automobile.

When this pad was subjected to the constant-speed friction test according to method of JIS D-4411, it was found that the friction coefficient at 250° C. was 0.45 and the abrasion loss was $1.48\times10^{-7}$ cm$^3$/kg·m.

EXAMPLE 8

The procedures of Example 7 were repeated in the same manner except that the fiber was cut into 5 mm and the fiber concentration in the dispersion was changed to 1%, whereby a brake pad was prepared.

When the brake pad was tested in the same manner as described in Example 7, it was found that the friction coefficient was 0.45 and the abrasion loss was $1.47\times10^{-7}$ cm$^3$/kg·m. Friction materials having the same performances were obtained with a good reproducibility.

EXAMPLE 9

A brake pad was prepared by treating a mixture comprising 40% of the acrylic synthetic fiber prepared in Example 6, 15% of a glass fiber, 22% of diatomaceous earth and 23% of a phenolic resin in the same manner as described in Example 7.

When the obtained brake pad was subjected to the abrasion test, it was found that the friction coefficient was 0.45 and the abrasion loss was $1.46\times10^{-7}$ $cm^3/kg\cdot m$.

As apparent from the foregoing description, the following effects can be obtained according to the present invention.

1. The acrylic synthetic fiber of the present invention can be easily split into fibers continuous in the longitudinal direction by an external force such as a high-pressure water stream.

Furthermore, according to the preparation process of the present invention, by spinning a spinning solution containing a specific polyalkylene glycol after aging, a fiber having many voids having an indeteminate shape in the transverse section of the fiber and being continuous in the longitudinal direction of the fiber can be easily obtained.

2. The acrylic synthetic fibrous article of the present invention is suitable for the production of a nonwoven fabric or paper-like product having a high elasticity and bulkiness, and the acrylic synthetic fibrous article of the present invention has characteristics suitable for a resin reinforcer and the like.

3. Since the friction material of the present invention is formed by using the fibrous article comprising fibers having a specific shape and structure, uniform mixing and close and integral conjugation can be accomplished, and therefore, the friction coefficient and abrasion resistance are greatly improved in the friction material of the present invention.

We claim:

1. An acrylic synthetic fiber comprising an acrylic synthetic fiber having in the interior of the fiber vein-like or straw-like voids extending substantially in parallel to the longitudinal axis of the fiber and having a length of at least 60 μm, wherein a transverse section of the fiber has a multiplicity of openings corresponding to the vein-like or straw-like voids and wherein said openings have an average diameter of 0.1 to 1.6 μm, in terms of an average diameter of a circumscribed circle of the opening, and the number of the openings in the transverse section of the fiber is at least 100.

2. An acrylic synthetic fiber according to claim 1 wherein the void ratio of the fibers is 5% to 80%.

3. An acrylic synthetic fiber according to claim 1, wherein the openings in the transverse section thereof have an average diameter of at least about 0.1 μm expressed in terms of the diameter of a circumscribed circle of the opening.

* * * * *